US005096197A

United States Patent [19]

Embury

[11] Patent Number: 5,096,197

[45] Date of Patent: Mar. 17, 1992

[54] CARD DECK SHUFFLER

[76] Inventor: Lloyd Embury, 169 Oakdale Road, Downsview, Ont. M3N 1W4, Canada

[21] Appl. No.: 704,583

[22] Filed: May 22, 1991

[51] Int. Cl.[5] ..... A63F 1/12

[52] U.S. Cl. ..... 273/149 R

[58] Field of Search ..... 273/149 R, 149 P

[56] References Cited

U.S. PATENT DOCUMENTS

| | | | |
|---|---|---|---|
| 564,774 | 7/1896 | Becker | 273/149 R |
| 2,159,958 | 5/1939 | Sachs | 273/149 R |
| 3,944,230 | 3/1976 | Fineman | 273/149 R |
| 4,586,712 | 5/1986 | Lorber et al. | 273/149 R |

FOREIGN PATENT DOCUMENTS

| | | | |
|---|---|---|---|
| 221349 | 4/1959 | Australia | 273/149 R |
| 414014 | 7/1934 | United Kingdom | 273/149 R |

*Primary Examiner*—Benjamin Layno

*Attorney, Agent, or Firm*—Bereskin & Parr

[57] ABSTRACT

A card deck shuffling device has a chute for receiving and guiding a deck of cards. The chute has an upper chamber and a lower chamber divided by a gate mechanism. The gate mechanism is moveable between closed, partially open and completely open positions. In the closed position the gate supports all of the cards in the upper chamber and blocks their passage into the lower chamber. In the partially opened position the gate blocks passage of a first portion of the cards while permitting the remainder of the cards to pass into the lower chamber. In the fully opened position the gate allows the first portion of the deck of cards to fall onto the cards in the lower chamber to intermingle with those cards to form a rearranged deck. The lower chamber can contain an agitator for agitating the cards to promote intermingling. The card deck shuffling device has a return mechanism for returning the rearranged deck back to the upper chamber.

16 Claims, 11 Drawing Sheets

CARD DECK SHUFFLER

FIELD OF THE INVENTION

This invention relates to devices for shuffling decks of playing cards.

BACKGROUND OF THE INVENTION

In playing any of the numerous games of cards, it is necessary to periodically randomly rearrange the sequence of the cards in a deck of cards to introduce an element of unpredictability in the outcome. This rearranging process is referred to as "shuffling".

Traditionally cards have been manually shuffled by dividing the deck in half and urging the edges of both halves together to cause the cards of one half to intermingle with the cards of the other half.

There are several problems which arise from the traditional manual method of shuffling cards using this method. Firstly, it is extremely difficult for a person not having full function of both arms and both hands to shuffle a deck of cards using this method. Secondly, a degree of motor skill is required to adequately shuffle a deck of cards which requires some time to develop. Accordingly, inexperienced card players such as children or infrequent players tend to drop or damage cards in the shuffling process. Thirdly, it is possible for persons skilled in the art of cheating at cards to manipulate the sequence of cards if they are permitted to touch the cards during the shuffling operation.

It is an object of this invention to provide a card deck shuffling device which is easy to operate, simulates the manual card shuffling operation and which is tamperproof. Other objects and advantages of the present invention will become apparent upon reviewing the detailed description set out below.

SUMMARY OF THE INVENTION

A card deck shuffling device is provided comprising:

a chute dimensioned to guide a deck of cards and having an upper chamber with an opening for receiving a deck of cards and a lower chamber below said upper chamber and communicating with said upper chamber through a movable gate;

a gate actuator for moving said gate from a closed position through a partially open position to a completely open position, in said closed position said gate blocking passage of said deck of cards from said upper chamber to said lower chamber to hold said deck in a starting position, in said partially open position said gate blocking passage of a first part of said deck from said upper chamber into said lower chamber while allowing passage of a second part of said deck into said lower chamber, in said fully open position said gate allowing passage of said first part of said deck into said lower chamber;

guide means for guiding said second part of said deck beneath said first part of said deck upon passage of said second part into said lower chamber to permit corresponding edges of said first and second parts of said deck to be presented to each other to allow intermingling of said first and second parts to form a rearranged deck; and, return means for returning said rearranged deck back to said starting position.

DESCRIPTION OF THE DRAWINGS

A preferred embodiment of the invention is described below with reference to the accompanying drawings in which.

DETAILED DESCRIPTION OF A PREFERRED EMBODIMENT OF THE PRESENT INVENTION

Figure 1:
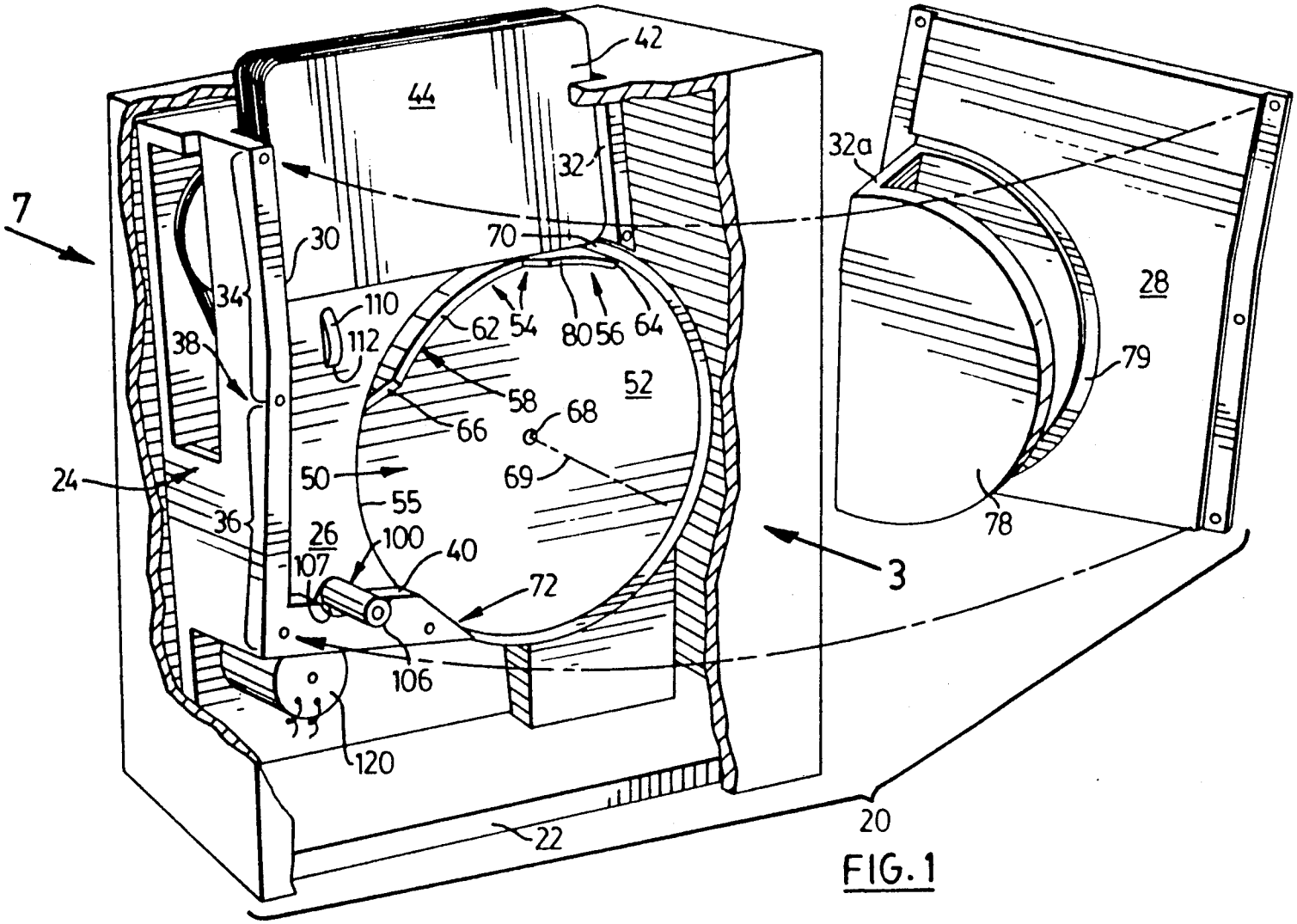
FIG. 1 is a perspective view from the front of a device according to the present invention.
Figure 9:
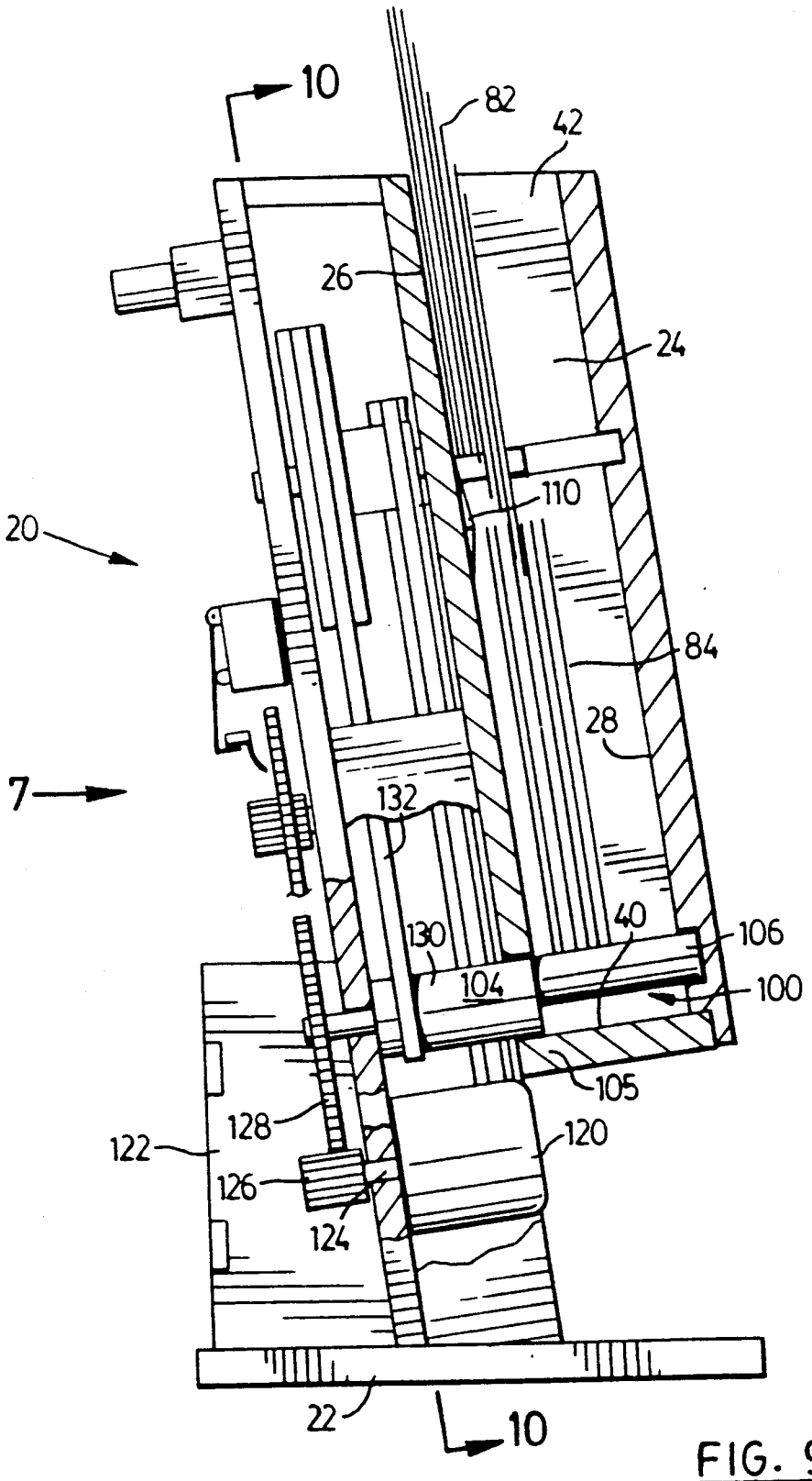
FIG. 9 is a side elevation in the direction of arrow 9 of FIG. 7.

A card deck shuffling device according to the present invention is generally shown at 20. The card deck shuffler 20 rests on a base 22. An upwardly opening generally rectangular chute 24 is mounted on the base 22. The chute 24 has a first side wall 26 opposite a second side wall 28 as best shown in FIGS. 1 and 9. The chute 24 further has a first end wall 30 opposite a second end wall 32. The first and second end walls, 30 and 32 respectively, extend between the first side wall 26 and the second side wall 28 of the chute 24.

The chute 24 has an upper chamber 34 above a lower chamber 36. The upper chamber 34 communicates with the lower chamber 36 through a passage at 38. The chute 24 also has a bottom wall 40 defining the bottom of the lower chamber 36.

As shown in FIGS. 3 through 6, the upper chamber 34 meets the lower chamber 36 at an angle at about the passage location 38. In addition, as shown in FIGS. 2, 8, 9 and 10, the plane of chute 24 is inclined from the vertical. The reasons for the angle and the incline are discussed further below.

The upper chamber 34 of the chute 24 has an opening 42 opening at its top. The breadth of the chute 24 between the first end wall 30 and the second end wall 32 corresponds generally to the length of a deck of cards 44. The width of chute 24 between side walls 26, 28 corresponds generally to the thickness of a deck of cards.

The card deck shuffler 20 has a movable gate generally shown at 50 which allows parts of the card deck to fall in a controlled sequence from upper chamber 34 to lower chamber 36. Gate 50 has a generally circular disc 52 outside chute 24 but adjacent the first side wall 26. The gate 50 has a cam member 54 extending generally circumferentially along an outer edge of the disc 52.

Cam member 52 protrudes through an opening 55 in side wall 26 into chute 24.

Figure 3:
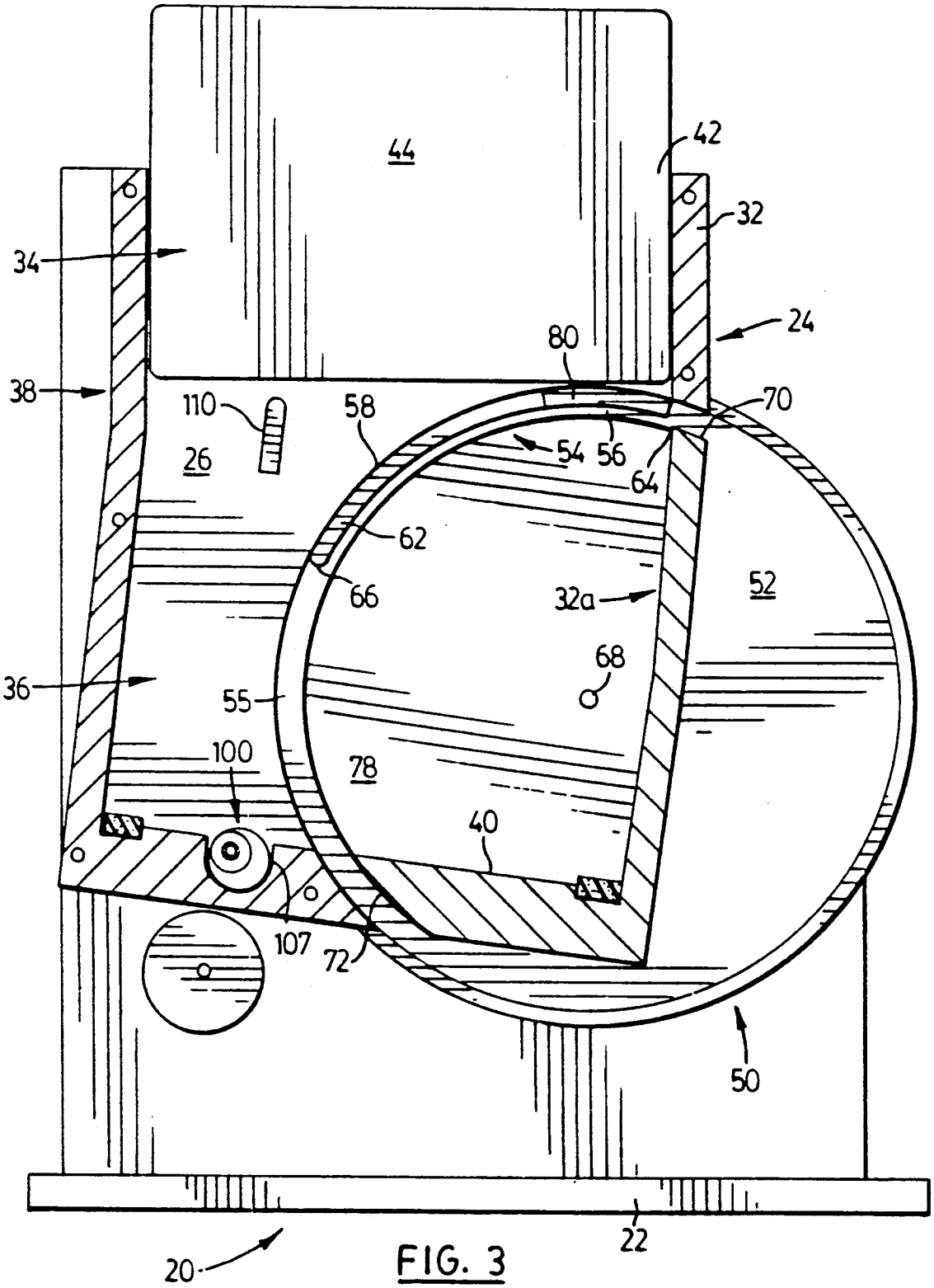
FIG. 3 is a front elevation of the FIG. 1 device with one side of the chute removed and showing a gate in a closed position;.
Figure 8:
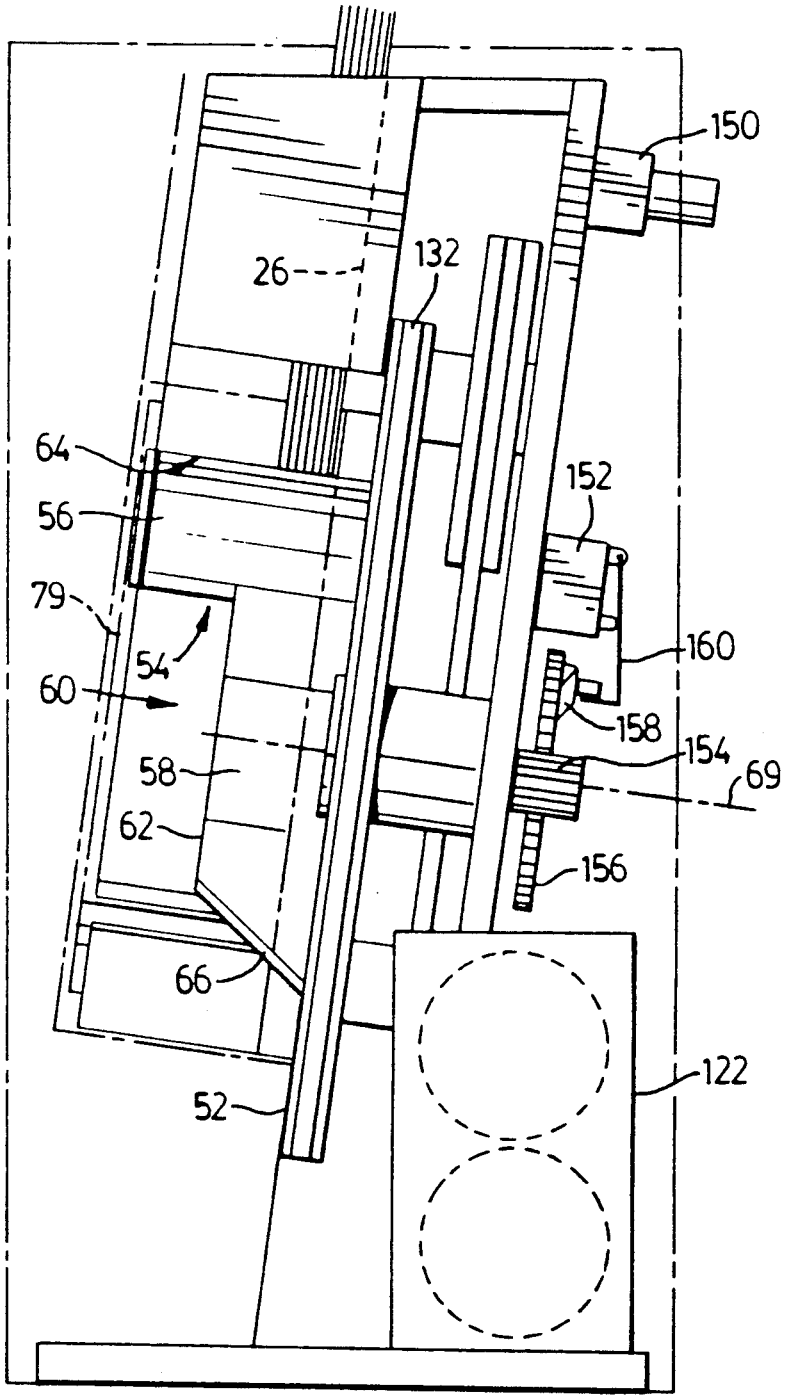
FIG. 8 is a side elevation in the direction of arrow 8 of FIG. 7.

The cam member 54 has a first part 56 which, in the orientation illustrated in FIGS. 3 and 8, extends across the lower chamber 36 from the first side wall 26 to the second side wall 28.

The cam member 54 further has a second part 58 adjacent the first part 56. The second part 58 extends approximately halfway across the lower chamber 36 when the second part 58 of the cam member 54 is in the lower chamber 36. Part 58 has an outer edge 62 which defines a gap 60 (FIG. 8) between outer edge 62 and side wall 28. The first part 56 of the cam member 54 has a first free end 64. The second part of the cam member 54 has a second free end 66. The first and second free ends, 64 and 66 respectively, define the outer ends of the cam member 54.

The disc 52 is mounted on a shaft 68 and is rotatable about an axis 69 generally perpendicular to the plane of the first side wall 26 of the chute 24. The second end wall 32 of the chute 24 and the bottom wall 40 of the chute 24 have (see FIG. 3) respective apertures 70 and 72 extending therethrough to allow cam member 54 to rotate therethrough as disc 52 rotates.

As shown in FIG. 1, the second side wall 28 carries a lower portion 32*a* at the end wall 32. The end wall portion 32*a* carries a generally semi-circular fixed disc portion 78 which fits into opening 55 of the first side wall 26. Disc portion 78 in effect forms with opening 55 a slot through which the member cam 54 can protrude into the chute 24.

The second side wall 28 also has a curved groove 79 extending into it to receive an outer edge 80 of the first part 56 of the cam member 54. As will become apparent below, the groove 79 enables the outer edge 80 to extend into the second end wall 28. This prevents cards from falling between the first part 56 of the cam member 54 and the side wall 28.

FIG. 3 shows the card shuffling device 20 with the movable gate 50 in "closed" position. In the closed position, the first part 56 of the cam member 54 extends beneath and supports the deck of cards 44 in a starting position in the upper chamber 34. The deck 44 cannot at this time fall from the upper chamber 34 into the lower chamber 36.

Figure 4:
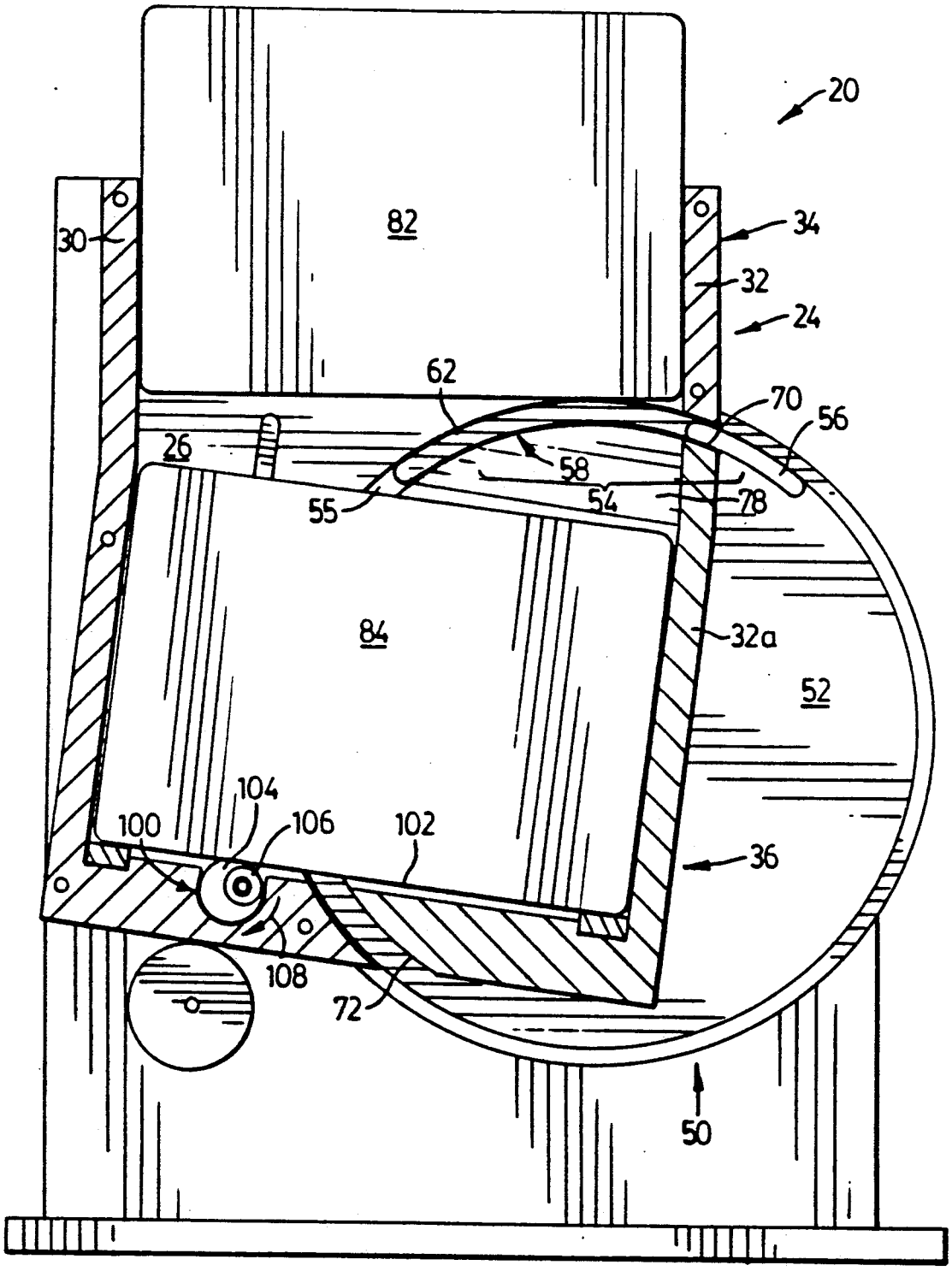
FIG. 4 is a view corresponding to FIG. 3 but with the gate in a partially opened position.

FIG. 4 shows the card shuffling device 20 with the gate 50 rotated clockwise from the FIG. 3 location into a partly open position. In the partly open position of FIG. 4, the first part 56 of the cam 54 is moved through slot 70 out of the chute 24, from beneath the deck of cards 44. In the partly open position, the second (and narrower) part 58 of the cam 54 supports a half 82 of the deck 44 directly and permits a second half 84 of the deck 44 to fall past the outer edge 62 of the second part 58 of the cam member 54 and into the lower chamber 36. Because the plane of the chute is inclined (FIGS. 8, 9), the second part 84 of the deck 44, after it falls, lies against first side wall 26 and disc portion 78, directly beneath the first part 82 of the deck 44.

Figure 5:
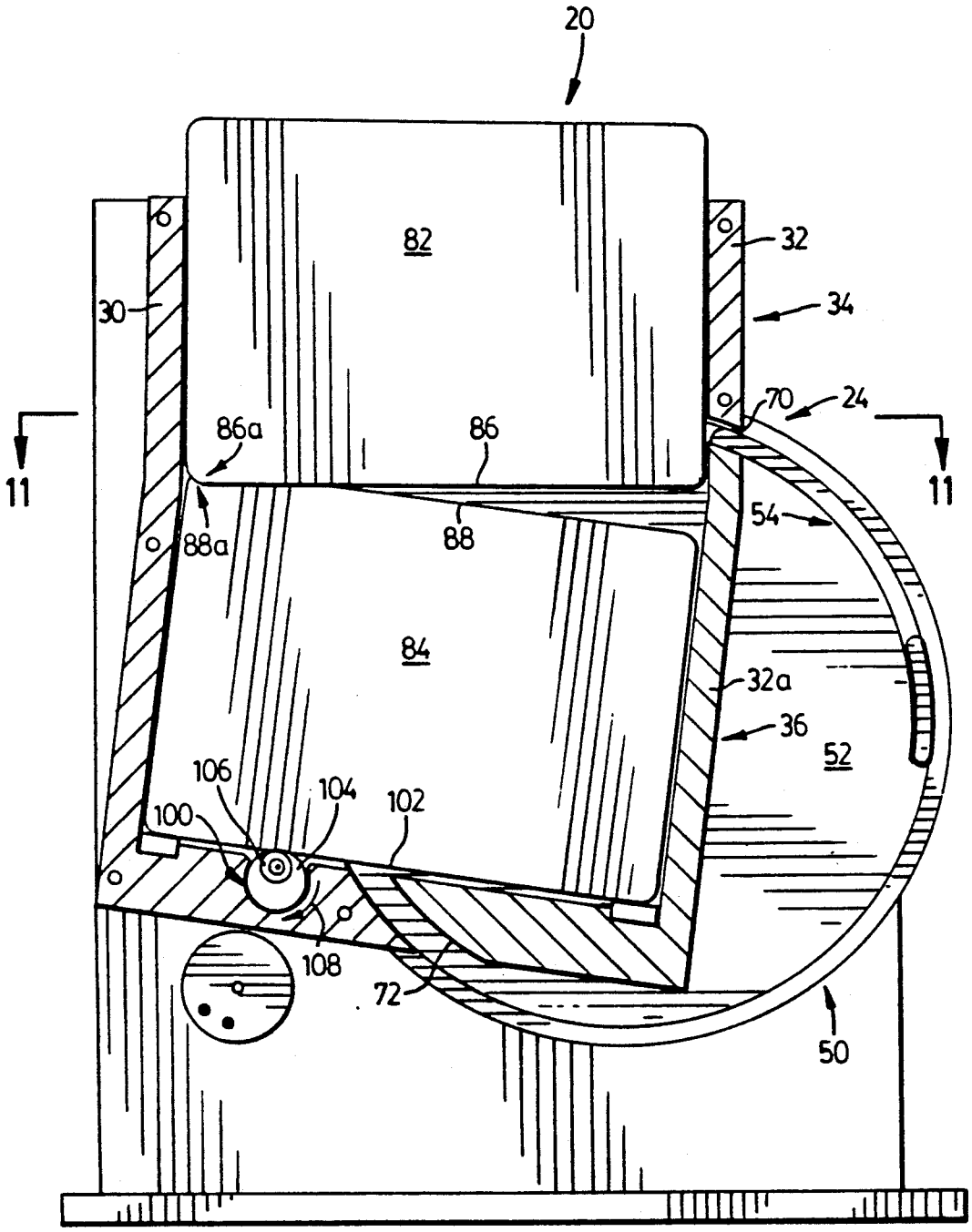
FIG. 5 is a view corresponding to FIGS. 3 and 4, and 5 but with the gate in a fully opened position.

FIG. 5 illustrates the card shuffling device 20 with the gate 50 in a fully opened position. In the fully opened position the cam member 54 has rotated clockwise entirely out of the chute 24. Cam member 54 now no longer supports the upper half 82 of the deck 44. This enables the upper half 82 of the deck 44 to fall toward the lower half 84 of the deck 44 in the lower chamber 36. Since the lower half 84 of the deck 44 has been guided beneath the upper part 82 of the deck 44, an edge 86 of the upper half 82 of the deck 44 is presented to a corresponding edge 88 of the lower half 84 of the deck 44. Furthermore, because of the angle between the upper chamber 34 and the lower chamber 36, the upper half 82 of the deck meets the lower half 84 of the deck at an angle so as to meet at corners 86*a*, 88*a*. Having the two halves of the deck 44 first contact each other at their corners, helps to ensure that the upper half 82 will properly penetrate lower half 84. This helps to ensure proper intermingling to form a shuffled deck 90 as shown in FIG. 6.

To further facilitate intermingling of the upper half 82 of the deck 44 with the lower half 84, the second free end 66 of the second part 58 of the cam member 54 may be angled as shown in FIG. 8. The angling of the second free end 66 makes the length of the second part 58 of the cam member decrease away from the first side wall 26. This causes cards furthest away from the first side wall 26 to fall sooner than the cards nearer the first side wall 26 as the cam member 54 is rotated. Therefore, instead of the entire top half 82 meeting the bottom half 84 of the deck 44 at one time the meeting becomes more sequential, helping interleaving of the two halves.

Figure 6:
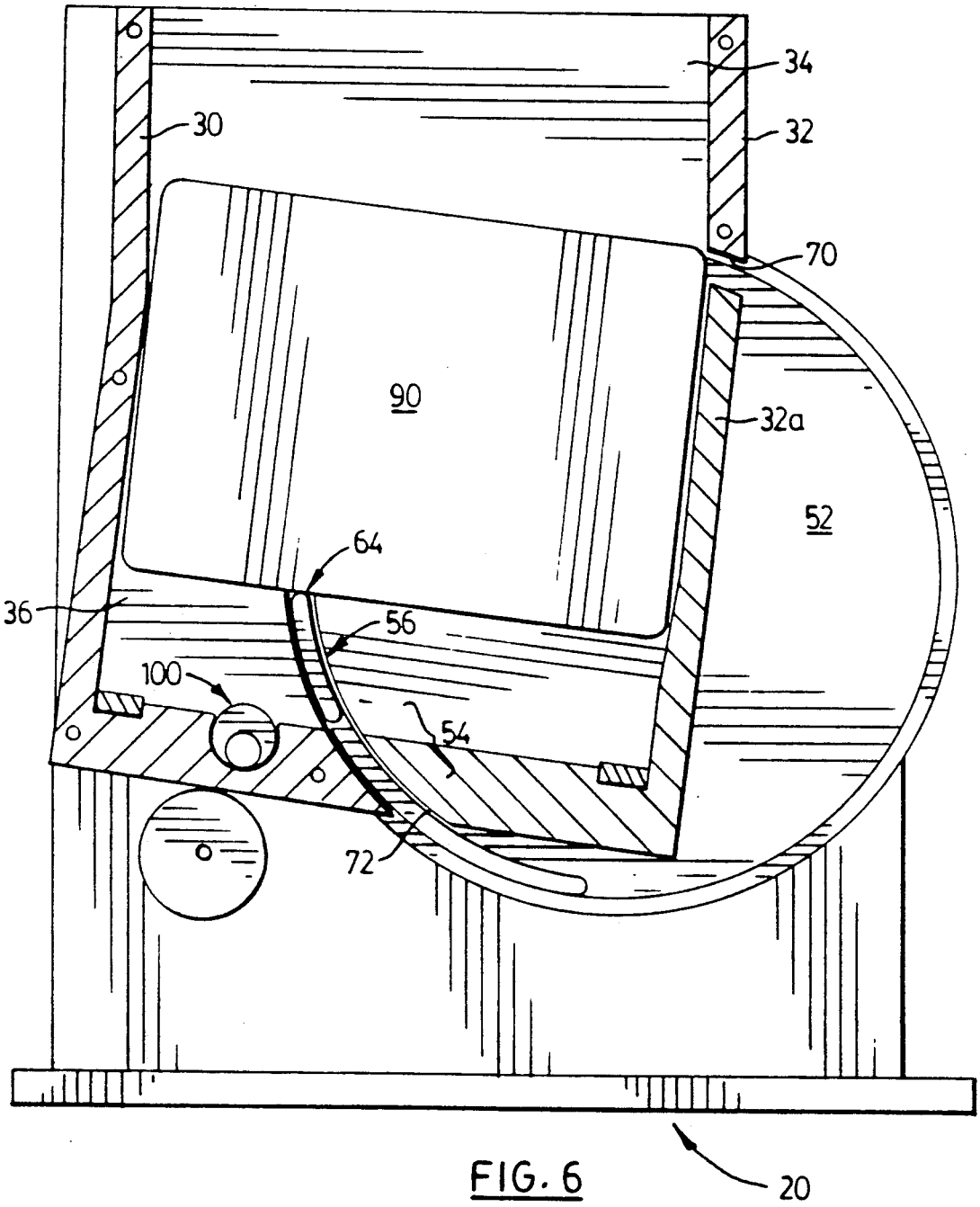
FIG. 6 is a view corresponding to FIGS. 3, 4 and 5 showing a return means in operation.
Figure 7:
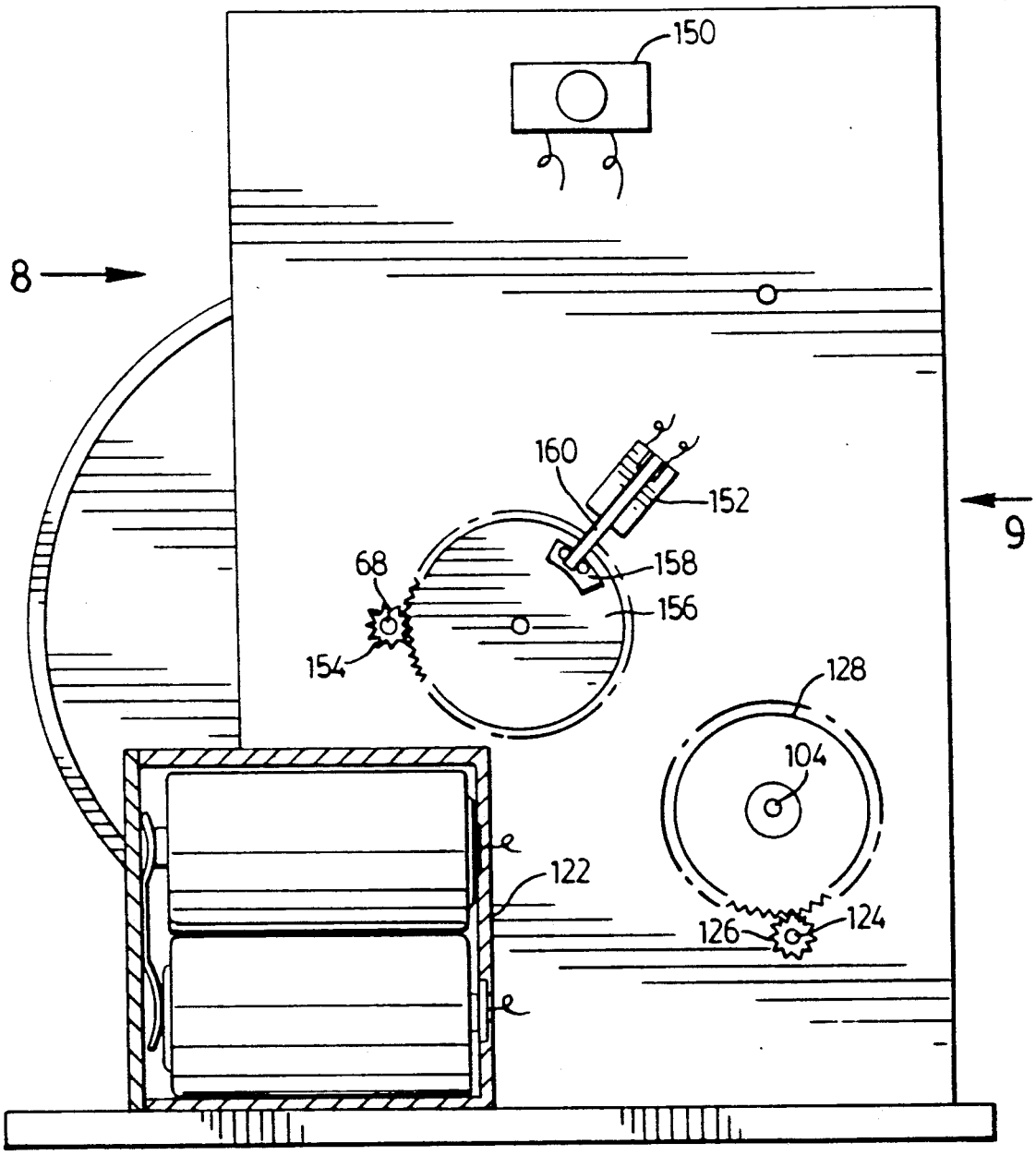
FIG. 7 is a rear elevation of the FIG. 1 device.

As the gate 50 continues to rotate, clockwise (FIG. 3 to 6), the first free end 64 reenters the chute 24 through the aperture 72 in the bottom wall 40 of the chute 24, as shown in FIG. 6. With further clockwise rotation of the gate 50, the free end 64 at the first part 56 of the cam 54 rises through the lower chamber 36 of the chute 24 thereby raising the once shuffled deck 90 upwardly to return the rearranged deck of cards to the starting position illustrated in FIG. 3. In this manner, the first part 56 of the cam 54 acts as a return means for returning the rearranged deck 90 to the starting position illustrated in FIG. 3.

The card shuffling device 20 has an agitator 100 in the lower chamber 36. The purpose of agitator 100 is to impart a reciprocating up and down motion to a lower edge 102 (FIG. 5) of the lower half 84 of the deck 44. This causes the lower half 84 of the deck 44 to dance up and down, to facilitate penetration and intermingling of the two halves of the deck 44. The agitator 100 includes a camshaft 104 (FIG. 9) extending through an opening 105 in side wall 26 at the bottom of the lower chamber 36. The camshaft 104 has a cam lobe or eccentric shaft 106 which extends across the bottom of lower chamber 36. The lobe 100 rotates into and out of a groove or well 107 at the bottom of chamber 36. Thus, the lower half 84 normally rests on the bottom of chamber 36 but is repeatedly rapidly impacted by lobe 106 as the camshaft 104 is rotated in the direction of arrow 108. Although one cam lobe 106 is illustrated in the drawings, the camshaft may have two or more lobes.

The first side wall 26 of the chute 24 has a deflector tab 110 near the top of the lower chamber 36. The deflector tab 110 is generally wedge shaped with the thinner end 112 of the wedge facing the bottom wall 40 of the chute 24. The location of the deflector tab 110 corresponds to the location of upper edge 88 of the lower half 84 of the deck 44 when the lower half 84 is in the lower chamber 36. As the lower half 84 of the deck 44 is moved up and down by the agitator 100, the deflector tab 110 will impart a small lateral motion to the top edge of the lower half 84, in and out of the plane of the page as viewed in FIG. 5. This lateral motion further facilitates the intermingling of the cards.

Drive for the gate 50 and for the agitator 100 is provided by an electric motor 120 mounted to the base 22 of the card shuffling device 20. The motor is connected to the gate 50 through a transmission comprising a series of gears, pulleys and belts which are best seen in FIGS. 7 to 11 and which are described in detail below. The motor may receive power from any suitable means such as a battery pack 122.

Figure 10:
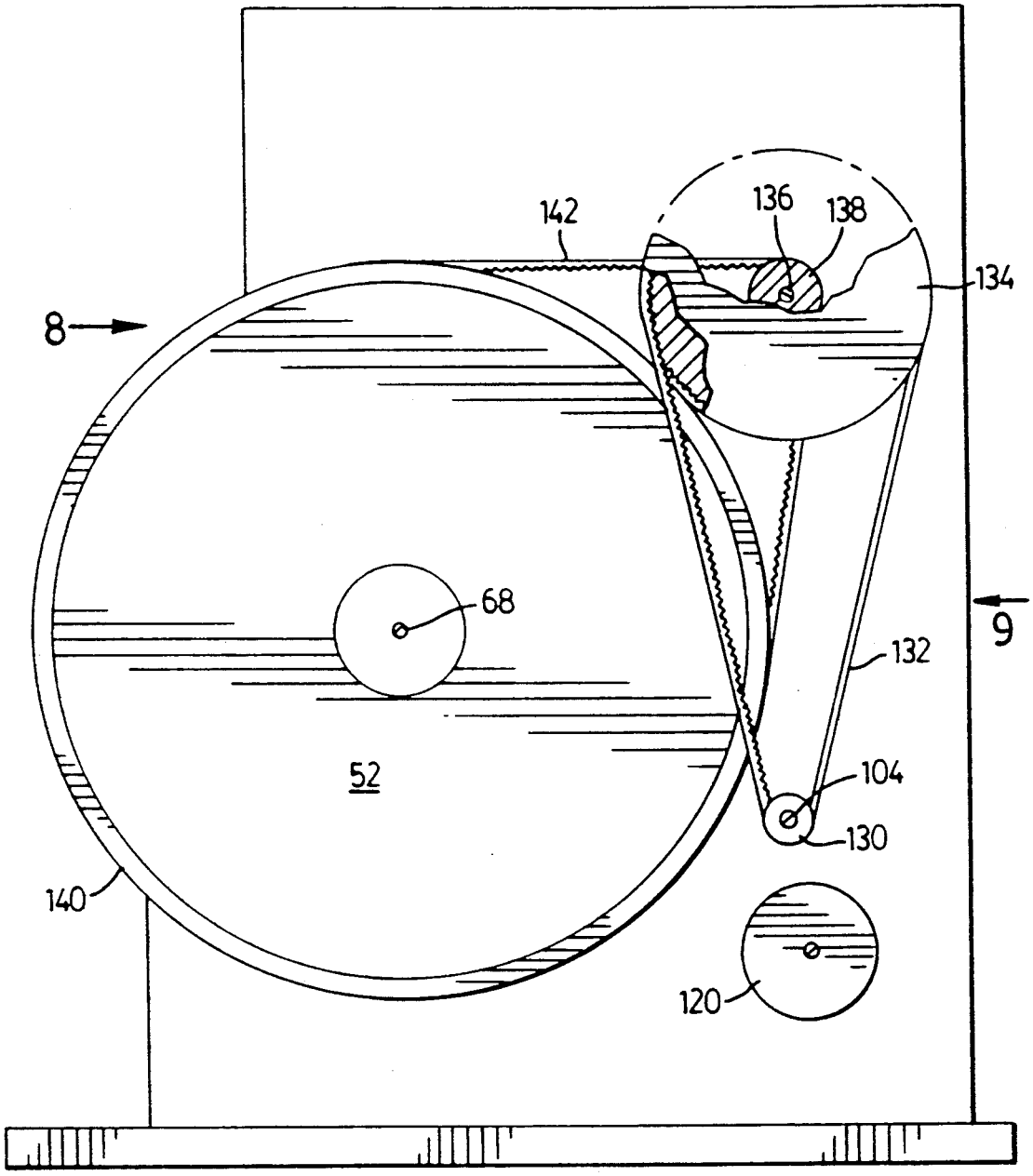
FIG. 10 is a section on Line 10—10 of FIG. 9.
Figure 11:
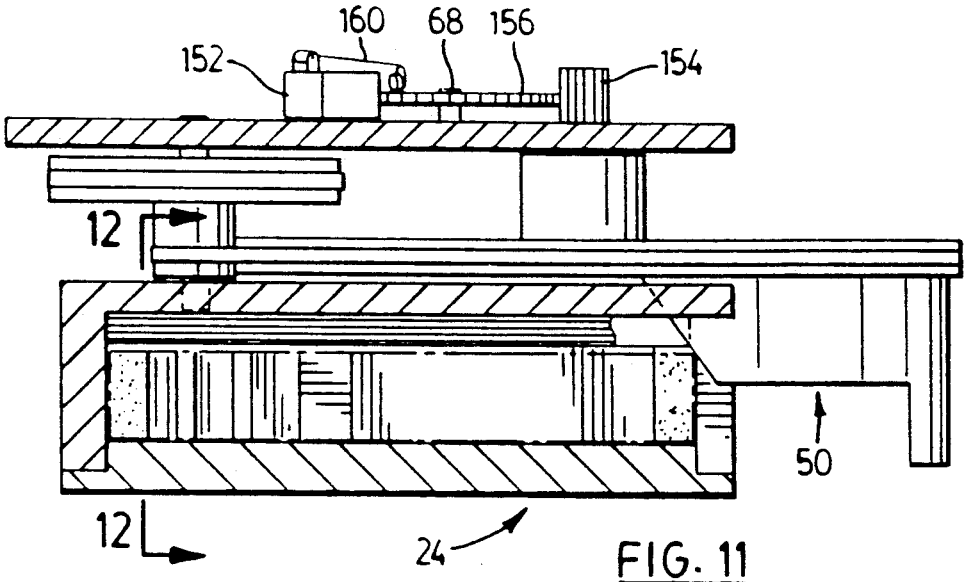
FIG. 11 is a partial top plan view of a device according to the present invention.
Figure 12:
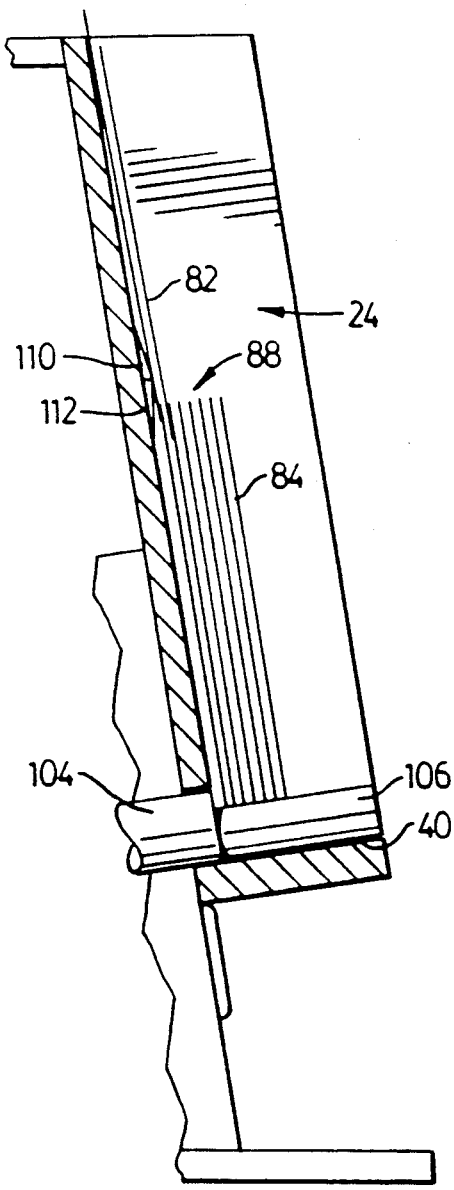
FIG. 12 is a section on line 12—12 of FIG. 11.

The electric motor 120 has an output shaft 124 on which is mounted a relatively small diameter gear 126 and which rotates with the output shaft 124. The output shaft gear 126 meshes with a larger gear 128 at one end of the camshaft 104. A driving pulley 130 is mounted at or formed in the opposite end of the camshaft 104 from the gear 128 and therefore the camshaft 104 acts as a drive shaft for providing drive from the gear 128 to the driving pulley 130. An endless belt 132 connects the driving pulley 130 to a first intermediate pulley 134 (FIG. 10). The first intermediate pulley 134 is mounted on a shaft 136. A second intermediate pulley 138 is also mounted on the shaft 136 behind the first intermediate pulley 134 as viewed in FIG. 10. The second intermediate pulley 138 is constrained to rotate with the first intermediate pulley 134.

The second intermediate pulley 138 is connected to a driven pulley 140 extending around the disc member 52 of the gage 50 by a second endless belt 142.

In use, the gear 126 on the output shaft 124 of the electric motor 120 rotates the gear 128 on one end of the camshaft 104. The camshaft 104 rotates and acts as a driving shaft to rotate the driving pulley 130 at the opposite end of the camshaft 104. The driving pulley 130 in turn drives the first intermediate pulley 134 through the first endless belt 132. The first intermediate pulley 134 rotates the second intermediate pulley 138. Finally, the second intermediate pulley 138 rotates the pulley 140 around the gate 50 through the second endless belt 142. This in turn causes rotation of the gate 50.

The gear 126 on the output shaft 124 of the motor 120 is of smaller diameter than the gear 128 on the camshaft 104. The pulley 130 on the camshaft is of smaller diameter than the first intermediate pulley 134. The second intermediate pulley 138 is of smaller diameter than the first intermediate pulley 134 and also of smaller diameter than the pulley 140 on the gate 50. It will therefore be appreciated that the transmission performs a speed reduction function to cause the gate 50 to rotate at a considerably lower speed than that of the output shaft 124 of the motor 120.

The card deck shuffling device 20 also has a position sensitive switch enables the device to be switched on and then complete a number of shuffling sequences before switching off in the starting position. The position sensitive switch means includes (FIG. 2) a normally open push button switch 150, a normally closed micro switch 152, first and second timing gears 154 and 156 respectively and a switch opening cam 158 mounted on the second timing gear 156.

The first timing gear 154 is mounted on the shaft 68 of the gate 50 and rotates with the gate 50. The first timing gear 154 drives the second timing gear 156. The second timing gear has a number of teeth corresponding to an integer multiple of the number of teeth on the first timing gear. Accordingly, the second timing gear will complete one revolution for each integer multiple number of revolutions of the fist timing gear 154. For example, if the integer multiple is six and gate 50 completes six revolutions, the timing gear 156 will have completed one revolution.

The micro switch 152 has an actuating arm 160 which is acted upon by the switch opening cam 158. The location of the switch opening cam 158 relative to the actuator arm 160 is selected so as to open the micro switch 152 when the gate is in the closed position shown in FIG. 3.

The micro switch 152 is connected in series between the power supply and the motor. The power supply is shown as battery pack 122. Accordingly, opening the micro switch 152 will normally cut off power to the electric motor 120 to stop operation of the motor and in turn to stop operation of the card shuffling device 20.

The normally open push button switch 150 is connected across (i.e. in parallel with) the normally closed micro switch 152. Pushing (i.e. closing) the push button switch 150 will therefore provide power to the motor 120 so long as the push button switch is held depressed, despite the micro switch 152 being open.

In order to start the card shuffling device 20, the push button switch 150 is closed and held, to turn on the motor 120 and commence operation of the device 20. As the motor drives the device 20, the second timing gear 156 will rotate so as to move the cam 158 away from the actuating arm 160 of the micro switch 152 to enable the micro switch 152 to close. Once the micro switch 152 has closed, the push button switch 150 may be released and the device will continue to operate until the cam 158 completes a full revolution and once again opens the micro switch 152.

Figure 2:
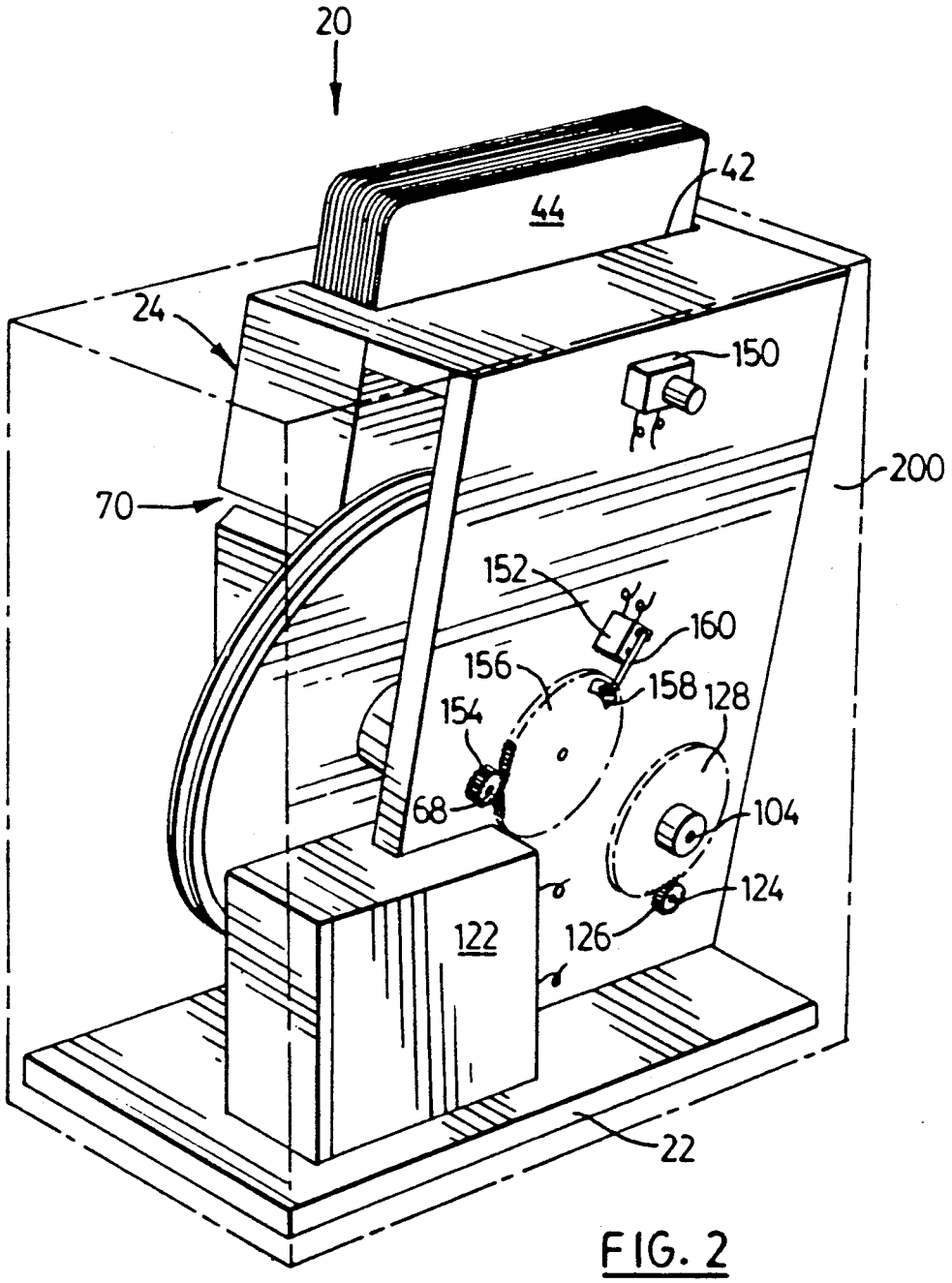
FIG. 2 is a perspective view from the rear of the FIG. 1 device.

The device 20 may be provided with a generally rectangular housing 200 as shown in ghost outline in FIG. 2. The chute 24 and the housing 200 may further be made from transparent material so that its operation can be viewed to ensure that no tampering is taking place.

The above detailed description should be interpreted in an illustrative rather than restrictive sense. Variations to the exact description of the components and their relative orientations may be apparent to those skilled in the relevant arts without departing from the spirit and scope of the present invention as defined in the claims set out below. For example, separate drive means may be employed for the agitator and the gate. Furthermore, drive means other than gear and belt may be used and the number of gears and pulleys may also be varied to suit the motor selected. Furthermore, terms such as "above" and "below", "upper" and "lower" assume that the device is in its operating position and that the weight of the cards will be relied upon to carry the cards downwardly into the chute. Furthermore, although the device has been described as operating with a single deck of cards, the device may be scaled up or down as appropriate to shuffle more or less than a deck of cards at a time.

I claim:

1. A card deck shuffling device comprising:

a chute dimensioned to guide a deck of cards and having an upper chamber with an opening for receiving a deck of cards and a lower chamber below said upper chamber and communicating with said upper chamber through a movable gate;

a gate actuator for moving said gate from a closed position through a partially open position to a completely open position, in said closed position said gate blocking passage of said deck of cards from said upper chamber to said lower chamber to hold said deck in a starting position;

in said partially open position said gate blocking passage of a first part of said deck from said upper chamber into said lower chamber while allowing passage of a second part of said deck into said lower chamber, in said fully open position said gate allowing passage of said first part of said deck into said lower chamber;

guide means for guiding said second part of said deck beneath said first part of said deck upon passage of said second part into said lower chamber to permit corresponding edges of said first and second parts of said deck to be presented to each other to allow intermingling of said first and second parts to form a rearranged deck; and, return means for returning said rearranged deck back to said upper chamber.

2. A card deck shuffling device as claimed in claim 1 wherein said chute includes a first side wall and said gate includes:

a disc member adjacent said first side wall of said chute and mounted for rotation in the plane of said first side wall about an axis generally perpendicular to said first side wall;

a cam member extending laterally from and generally circumferentially along an outer edge of said disc member toward the interior of said chute;

said cam member having a first part capable of spanning said chute from said disc member to a second side wall of said chute opposite said first side wall;

said cam member further having a second part adjacent said first part and capable of extending part way across said lower chamber to define a gap between an outer edge of said second part and said second, side wall, the width of said gap corresponding to the thickness of said second part of said deck of cards;

said cam member still further having first and second outer free ends corresponding respectively to said first and second parts, said outer free ends being spaced circumferentially apart to enable a deck of cards to pass therebetween; and wherein, said closed position corresponds to said gate being oriented with said first part of said cam beneath said deck of cards to support said deck of cards;

said partially open position corresponds to said gate being oriented with said first part of said cam remote from said deck and with second part of said cam beneath said first part of said deck to support said first part of said deck; and said fully open position corresponds to said gate being oriented with said cam being clear of said deck.

3. A device as claimed in claim 2 wherein: said chute includes opposite end walls extending between said first and second side walls and a bottom wall defining the bottom of said lower chamber; said bottom wall and one of said opposite end walls each has an aperture to permit passage of said cam into and out of said chute;

said second side wall has a groove extending into it for receiving an outer edge of said first part of said cam as said first part of said cam is passed through said chute; and said first side wall has an opening connecting said apertures in said end and bottom walls to permit passage of said cam between said apertures.

4. A device as claimed in claim 3 wherein said free end of said first part of said cam engages a lower edge of said rearranged deck as said gate is moved from said open position to said closed position to act as said return means and lift said rearranged deck back to said starting position.

5. A device as claimed in claim 4 further including an agitator in said lower chamber for engaging a lower edge of said second part of said deck and for imparting a reciprocating motion to said second part of said deck to agitate said deck and facilitate intermingling of said first and second parts of said deck.

6. A device as claimed in claim 5 wherein: said chute is inclined from the vertical for said first side wall to act as said guide means;

said lower chamber has a tab projecting into it from said first side wall to guide the top of said second part of said deck outwardly from said wall as said second part of said deck is being agitated; and said upper chamber of said chute meets said lower chamber of said chute at an angle to present said first and second parts of said deck at an angle to each other when said gate is moved to said fully open position.

7. A device as claimed in claim 6 wherein said agitator further comprises at least one cam lobe protruding radially from a camshaft extending across the bottom of said lower chamber.

8. A device as claimed in claim 7 wherein said gate is rotated by an electric motor through a transmission means connecting said gate to said motor.

9. A device as claimed in claim 8 wherein said transmission means includes:

a driving pulley connected to said motor;

a driven pulley connected to said gate; and, at least one endless belt linking said driving and driven pulleys.

10. A device as claimed in claim 9 further including a pair of intermediate pulleys mounted on a shaft and connected to said driving and driven pulleys to provide a speed reduction between said driving pulley and said driven pulley.

11. A device as claimed in claim 10 wherein said driving pulley is mounted on a driving shaft and said driving shaft is coupled to said motor by a gear on said driving shaft which meshes with a relatively smaller diameter gear on the output shaft of said motor to provide further speed reduction between said motor and said gate.

12. A device as claimed in claim 11 wherein said driving shaft also acts as said camshaft of said agitator means.

13. A device as claimed in claim 8, 9, 10, 11 or 12 further including position sensitive switch means for stopping said motor when said gate is in said closed position after a predetermined number of complete revolutions of said gate.

14. A device as claimed in claim 8, 9, 10, 11 or 12 further having position sensitive switch means for stopping said motor when said gate is in said closed position after a pre-determined number of complete revolutions of said gate, said position sensitive switch means comprising:

a normally closed switch connected in series between said motor and a power supply to said motor;

a switch opening cam coupled to said gate by cam drive means to move with said gate, said cam being positioned to act against said normally closed switch to open said switch and interrupt power flow to said motor when said gate is in a closed position: and, a normally open switch connected across said normally closed switch, said normally open switch being closable to provide power to said motor until said switch opening cam moves to a position allowing said normally open switch to close.

15. A device as claimed in claim 8, 9, 10, 11 or 12 further having position sensitive switch means for stopping said motor when said gate is in said closed position after a pre-determined number of complete revolutions of said gate, said position sensitive switch means comprising:

a normally closed switch connected in series between said motor and a power supply to said motor;

a switch opening cam coupled to said gate by cam drive means to move with said gate, said cam acting against said normally closed switch to open said switch and interrupt power flow to said motor when said gate is in a closed position;

a normally open switch connected across said normally closed switch, said normally open switch being closable to provide power to said motor until said switch opening cam moves to a position allowing said normally closed switch to close;

and wherein said switch opening cam drive means includes a first timing gear connected to and rotatable with said gate and meshing with a second timing gear on which said cam is mounted, the number of teeth on said second timing gear being an integer multiple of the number of teeth on said first timing gear.

16. A device as claimed in claim 8, 9, 10, 11 or 12 further including:

position sensitive switch means for stopping said motor when said gate is in said closed position after a predetermined number of revolutions of said gate; and wherein said outer free end of said second part of said cam is inclined toward said outer edge of said first part of said cam to promote repeated movement of the cards of said first part of said deck as said gate moves toward said partially open position.

* * * * *